US011047187B2

(12) United States Patent
Fairweather et al.

(10) Patent No.: US 11,047,187 B2
(45) Date of Patent: Jun. 29, 2021

(54) WELL ABANDONMENT AND SLOT RECOVERY

(71) Applicant: ARDYNE HOLDINGS LIMITED, Aberdeen (GB)

(72) Inventors: Alan Fairweather, Aberdeenshire (GB); Michael Wardley, Aberdeen (GB); George Telfer, Aberdeen (GB)

(73) Assignee: ARDYNE HOLDINGS, LIMITED, Aberdeen (GB)

( * ) Notice: Subject to any disclaimer, the term of this patent is extended or adjusted under 35 U.S.C. 154(b) by 3 days.

(21) Appl. No.: 16/609,602

(22) PCT Filed: May 18, 2018

(86) PCT No.: PCT/GB2018/051345
§ 371 (c)(1),
(2) Date: Oct. 30, 2019

(87) PCT Pub. No.: WO2018/211284
PCT Pub. Date: Nov. 22, 2018

(65) Prior Publication Data

US 2020/0063515 A1 Feb. 27, 2020

(30) Foreign Application Priority Data

May 19, 2017 (GB) ..... 1708091

(51) Int. Cl.
*E21B 23/06* (2006.01)
*E21B 34/10* (2006.01)

(52) U.S. Cl.
CPC ..... *E21B 23/06* (2013.01); *E21B 34/10* (2013.01); *E21B 2200/06* (2020.05)

(58) Field of Classification Search
CPC ..... E21B 23/06
(Continued)

(56) References Cited

U.S. PATENT DOCUMENTS 5,101,895 A 4/1992 Gilbert
2005/0211446 A1 9/2005 Ricalton et al.
(Continued)

FOREIGN PATENT DOCUMENTS

WO 2013054099 A2 4/2013
WO 2014197133 A1 12/2014
WO 2017034585 A1 3/2017

OTHER PUBLICATIONS

International Preliminary Report on Patentability dated Nov. 19, 2019 for PCT/GB2018/051345.
(Continued)

*Primary Examiner* — Taras P Bemko
(74) *Attorney, Agent, or Firm* — Law Office of Jesse D. Lambert. LLC

(57) ABSTRACT

A resettable mechanism for preventing the accidental actuation of a load set downhole tool and method of use. The resettable mechanism provides a collet (52) and a detent (56) with a collet ring arranged to ride over the detent under a load in excess of the operating load of the downhole tool and the collet load. Reversing the loading resets the mechanism and the downhole tool. A disengagement assembly (66) is described to disenable the detent (56) and operate the downhole tool at the operating load. Embodiments to a retrievable mechanical tension-set packer and a casing cutting and removal system are described which prevent premature actuation of the packer when run from floating structures.

19 Claims, 8 Drawing Sheets

(58) Field of Classification Search
USPC ..... 166/377
See application file for complete search history.

(56) References Cited

U.S. PATENT DOCUMENTS

| | | | | |
|---|---|---|---|---|
| 2012/0160523 | A1 | 6/2012 | Burgos | |
| 2012/0285684 | A1 | 11/2012 | Crow et al. | |
| 2014/0246190 | A1* | 9/2014 | MacKenzie | E21B 23/00 166/155 |
| 2014/0360734 | A1* | 12/2014 | Doane | E21B 33/1285 166/374 |

OTHER PUBLICATIONS

UK Search and Examination Report dated Jun. 16, 2017 for GB1708091.2.
International Search Report dated Aug. 14, 2018 for PCT/GB2018/051345.

* cited by examiner

WELL ABANDONMENT AND SLOT RECOVERY

The present invention relates to methods and apparatus for well abandonment and slot recovery and in particular, though not exclusively, to an improved apparatus for casing recovery.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to set a bridge plug to support cement; to create a cement plug in the casing; to cut the casing above the cement plug; and to pull the casing from the well. A further trip can then be made to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling can be achieved on a single trip.

When cutting and pulling casing it is advantageous to test for circulation after the cut is completed. Such a test ensures that if there is any build-up of gas bubbles these can be circulated out of the well and also determines if the cut casing section can be pulled. The presence of drilling fluid sediments, cement, sand or other debris behind the casing can prevent the casing from being pulled. In these circumstances a higher cut must be made and again circulation is tested to determine if the casing can be pulled. These steps may occur multiple times until a casing section can be retrieved. Thus it is a requirement of the combined casing cutter and spear tools that they should provide for multiple cuts and circulation tests on a single trip.

A difficulty in the design of such combined cutter and spear tools is that when cutting, circulation needs to be maintained with the return path in the annulus between the work string and the casing so that cuttings can return to surface, however for the circulation test this return path needs to be closed to force the return path to be through the cut and behind the casing to surface.

U.S. Pat. No. 5,101,895 to Smith International, Inc. discloses a remedial bottom hole assembly for casing retrieval having a spear and an inflatable packer utilized in combination with a pipe cutter. With such an assembly, after the spear is set and the casing is cut, the packer can be inflated to determine if circulation can be established without the removal of the spear and pipe cutter.

There are a number of disadvantages with this assembly. Not actuating a seal until the cut is made in order to allow for circulation during the cut leaves the well open so that if a kick occurs during the casing cutting it becomes difficult to quickly get control of the well, as the inflatable packer cannot be set in these circumstances. Additionally, the inflatable packer is operated by a drop ball which requires a choke in the string to get the back pressure for actuation. Such a restriction induces high velocity flow at the choke which causes erosion and potential washout. Yet further, to switch the assembly between modes requires a one eighth turn of the string. Such manipulation cannot reliably be achieved when a cut is made far from surface.

US 2012/0285684 to Baker Hughes Inc. discloses a cut and pull spear configured to obtain multiple grips in a tubular to be cut under tension. The slips are set mechanically with the aid of drag blocks to hold a portion of the assembly while a mandrel is manipulated. An annular seal is set in conjunction with the slips to provide well control during the cut. An internal bypass around the seal can be in the open position to allow circulation during the cut. The bypass can be closed to control a well kick with mechanical manipulation as the seal remains set. If the tubular will not release after an initial cut, the spear can be triggered to release and be reset at another location. The mandrel is open to circulation while the slips and seal are set and the cut is being made. Cuttings are filtered before entering the bypass to keep the cuttings out of the blowout preventers.

Like the assembly of U.S. Pat. No. 5,101,895 this tool requires measured rotation of the string to switch the tool between modes to undertake a circulation test and to cut the casing, as these tools all operate using j-slot mechanisms. Such manipulation cannot reliably be achieved when a cut is made far from surface.

The present Applicants have advantageously determined that a tension-set packer overcomes the disadvantages in the prior art as it is capable of sealing the annulus between the drill string and the casing both for testing and in case of a kick, while also keeping the annulus clear during cutting. The present Applicants now have the TRIDENT™ system. The TRIDENT™ system operates by providing an anchor to the casing, a casing cutter to cut the casing and a tension-set packer to provide a seal over the annulus between the string and casing to create a circulation path behind the casing and so aid casing recovery all in a single trip in the well bore.

In this arrangement, the anchor is set to provide stability for the cutter to allow for a fixed point for an overpull to be applied to set the packer. As with all such load set downhole tools i.e. weight set or tension set, they may have difficulties when used from floating rigs such as semi-submersibles. As they are anchored to the casing, sea swell will place tension and/or weight on the drill string and consequently there is a risk that the downhole tool is accidentally actuated by the increased load when a freak wave or lag is experienced at the floating rig. While heave compensators can be used, these still result in movement and the consequential variable load being applied. A known method to prevent the accidental actuation of the downhole tool is to insert a shear pin rated at a higher shear force than the predicted load which may occur in operation. Actuation of the downhole tool must then be achieved with an increased load i.e. a high overpull or significant weight. While the shear pin prevents accidental actuation, it also prevents the downhole tool being re-set. Thus for the tension-set packer multiple circulation tests cannot be performed. This is a major disadvantage.

It is therefore an object of the present invention to provide a resettable mechanism to prevent accidental actuation of a load set downhole tool.

It is an object of at least one embodiment of the present invention to provide a high overpull tension-set packer.

It is a further object of the present invention to provide a casing cutting and removal assembly on which multiple circulation tests can be performed on a single trip in the well.

According to a first aspect of the present invention there is provided a resettable mechanism for preventing the accidental actuation of a load set downhole tool, the downhole tool being actuated by an operating load, comprising:

a substantially tubular body having a central throughbore, with first and second ends;

an inner actuating member, the inner actuating member being an annular body having a first end for connection to an operating member of the downhole tool;

a collet including a detent, the detent having first and second faces and the detent being radially moveable upon application of a load;

a collet ring, the collet ring having third and fourth faces;

the collet and collet ring being arranged within the tubular body, so that: in a first configuration the first face can abut the third face and the detent prevents movement of the inner actuating member until a first load is applied in a first direction; and in a second configuration the detent prevents movement of the inner actuating member until a second load is applied in a second direction relative to the tubular body when the second face abuts the fourth face; and wherein the first load is greater than a combined load of the operating load and a collet load; and the second load is applied in reverse to the first load.

In this way, the collet is set to move radially only when a load greater than the highest accidental load which may be experienced by the downhole tool, in use, is applied. Thus a downhole tool, operable by a relatively low actuating load, can be used without the risk of accidental actuation. Additionally, the mechanism can be reset by reversing the load i.e. if a reduction in tension applied by setting down weight or if weight applied by pulling to apply tension. The load required to reset i.e. the second load can also be much smaller than the first load.

Preferably the collet is attached to the tubular body. The collet may be formed integrally with the tubular body. More preferably the detent is directed radially inwards. In this way, the collet can be located between the tubular body and the inner actuating member to prevent fouling of the collet fingers.

Preferably, the collet ring is supported on the inner actuating member. In this way, movement of the collet ring over the detent causes the downhole tool to actuate when load is applied in a first direction and release when a load is applied in a reverse, second direction.

Preferably the resettable mechanism comprises a disengagement assembly, the disengagement assembly disabling the detent so that the downhole tool can be actuated at the operating load in a third configuration. In this way, actuation of the downhole tool can be achieved when the string is not anchored to fixed structure.

Preferably the disengagement assembly comprises a collet ring support means, the support means holding the collet ring against a shoulder on the inner actuating member in a first position and releasing the collet ring to move relative to the inner actuating member in a second position. In this way the inner actuating member can move freely past the detent in the first direction when the disengagement assembly is in the second position.

Preferably the support means comprises a plurality of collet dogs arranged circumferentially around the inner actuating member. More preferably each collet dog is located in a retaining aperture through the inner actuating member. Preferably a portion of each collet dog protrudes from an outer surface of the inner actuating member to provide a face to abut against the collet ring in the first position. In this way, the collet dogs support the collet ring until they are removed from the apertures.

Preferably, the collet dogs are held in the first position by an inner sleeve located in the central throughbore. Preferably the inner sleeve includes a ball seat and is held to the inner actuating member by one or more shear screws in the first position. In this way the sleeve can be released to move relative to the inner actuating member by action of a drop ball.

More preferably, the inner sleeve includes an inner recess into which the collet dogs will fall when the disengagement assembly moves into the second position. Preferably also, the inner sleeve comprises first and second ports arranged on either side of the ball seat. More preferably, the ports align with a recess on the inner actuating member in the second position so that a fluid pathway is maintained from a first end to a second end of the resettable mechanism.

According to a second aspect of the present invention there is provided a method of controlled actuation of a load set downhole tool; the method comprising the steps:

(a) mounting a resettable mechanism according to first aspect with a load set downhole tool in a string and connecting the inner actuating member to an operating member of the downhole tool;

(b) arranging the resettable mechanism in a first configuration wherein the first face can abut the third face and the detent prevents movement of the inner actuating member in a first direction;

(c) applying a first load, greater than an operating load of the downhole tool and a collet load, in the first direction sufficient to move the collet radially and allow the inner actuating member to move in the first direction to the second configuration and thereby actuate the downhole tool; and (d) applying a second load, in the second direction so as to abut the second face and the fourth face and then move the collet ring over the detent to return the mechanism to the first configuration and thereby reset the mechanism and deactivate the downhole tool.

In this way, the downhole tool is prevented from actuating until a load greater than its operating load plus the collet load is applied and then the mechanism can be reset so that the downhole tool may be actuated any number of times.

The first direction may be downstream so that the downhole tool is a tension set tool. Alternatively, the first direction may be upstream so that the downhole tool is a weight set tool.

Preferably the method includes repeating steps (e) and (d) to repeatedly actuate the downhole tool.

Preferably the method includes the step of operating the disengagement assembly, so disabling the detent in a third configuration. The method may then comprise the further step of actuating the downhole tool at the operating load.

Preferably the method includes the step of releasing support of the collet ring so that it can move relative to the inner actuating member.

Preferably the method includes the step of dropping a ball through the central throughbore to operate the disengagement assembly. More preferably, the method includes the step of maintaining a flow path through the release mechanism in each configuration.

According to a third aspect of the present invention there is provided a high overpull mechanical tension-set retrievable packer configured to seal to casing or a downhole tubular, comprising:

a substantially tubular body having a central throughbore, with first and second ends including connection means for mounting in a string;

a mandrel which is configured to be axial moveable relative to a tool body;

at least one packer element; and a resettable mechanism according to the first aspect wherein the mandrel is connected to inner actuating member.

An upward force or tension applied to the string axially may move the mandrel relative to the tool body. The axial movement of the mandrel relative to the tool body in the first direction may actuate and set the mechanical tension-set retrievable packer. The axial movement of the mandrel relative to the tool body in the second direction may de-actuate the mechanical tension-set retrievable packer.

The packer element may be made from any material capable of radially expanding when it is axially compressed such as rubber.

The upward force or tension required to the set the mechanical tension-set retrievable packer alone may range from 20,000 lbs to 80,000 lbs. Preferably the upward force or tension to the set the mechanical tension-set retrievable packer alone is 30,000 lbs. Thus the operating load may be around 15 tonnes.

Preferably the collet load is around 30 tonnes. This provides a combined operating load and collet load of around 45 tonnes. The first load may be greater than 45 tonnes. More preferably the first load is around 70 tonnes. This ensures the packer will set.

The axial movement of the mandrel relative to the tool body in the first direction radially expands the packer element. The radially expansion of the packer element may seal the wellbore. The axial movement of the mandrel relative to the tool body in the second direction radially contracts the packer element.

Preferably the mechanical tension-set retrievable packer comprises at least one port configured to be in fluid communication with the annulus of the casing and/or downhole tubular. The at least one port may be configured to allow fluid communication between the throughbore and the annulus of the casing and/or downhole tubular below the mechanical tension-set retrievable packer.

The axial movement of the mandrel relative to the tool body in the first direction may open the at least one port. The axial movement of the mandrel relative to the tool body in the second direction may close the at least one port.

According to a fourth aspect of the present invention there is provided a method of controlled setting of a mechanical tension-set retrievable packer, the method comprising the steps:

(a) mounting mechanical tension-set retrievable packer according to the third aspect in a string;
(b) arranging the resettable mechanism in a first configuration wherein the first face can abut the third face and the detent prevents movement of the inner actuating member in a first direction;
(c) applying a first load, greater than an operating load of the mechanical tension-set retrievable packer and a collet load, in the first direction sufficient to move the collet radially and allow the inner actuating member to move in the first direction to the second configuration and thereby set the mechanical tension-set retrievable packer to seal against a casing; and
(d) applying a second load, in the second direction so as to abut the second face and the fourth face and then move the collet ring over the detent to return the mechanism to the first configuration and thereby reset the mechanism and release the mechanical tension-set retrievable packer from the casing.

Preferably the method includes cycling steps (c) and (d) to repeatedly set and unset the mechanical tension-set retrievable packer.

Preferably the method includes the step of operating the disengagement assembly, so disabling the detent in a third configuration. The method may then comprise the further step of setting the mechanical tension-set retrievable packer at the operating load. In this way, lighter fish such as cut casing can be removed were the string is not anchored to a fixed point.

Preferably the method includes the step of releasing support of the collet ring so that it can move relative to the inner actuating member.

Preferably the method includes the step of dropping a ball through the central throughbore to operate the disengagement assembly. More preferably, the method includes the step of maintain a flow path through the mechanical tension-set retrievable packer in each configuration.

According to a fifth aspect of the present invention there is provided a casing cutting and removal assembly comprising:

an anchor mechanism configured to grip a section of a tubular in a wellbore;

a mechanical tension-set retrievable packer according to the third aspect; and a casing cutter configured to cut the tubular;

wherein the anchor mechanism is located between the mechanical tension-set retrievable packer and the casing cutter.

In this way, repeated circulation tests can be performed on a single trip in the well without concern that the mechanical tension-set retrievable packer will accidentally set if operated from a floating rig.

The casing cutting and removal assembly may further comprise a drill, the drill being located at a distal end of the casing cutting and removal assembly. Mounting a drill bit on the end of the casing cutting and removal assembly allows initial dressing of a cement plug prior to casing cutting being achieved on the same trip into the wellbore.

Alternatively, the casing cutting and removal assembly may further comprise a bridge plug, the bridge plug being located at a distal end of the casing cutting and removal assembly. Mounting a bridge plug on the end of the casing cutting and removal assembly allows setting of a bridge plug in the casing prior to casing cutting being achieved on the same trip into the wellbore.

The drill or bridge plug may be hydraulically or pneumatically actuated. In this way the drill or bridge plug can be operated from surface without actuation of the anchor mechanism, mechanical tension-set retrievable packer or the casing cutter.

According to a sixth aspect of the invention there is provided a method of performing a circulation test in a wellbore comprising:

(a) providing a casing cutting and removal assembly according to the fifth aspect;
(b) actuating the anchor mechanism to grip a section of a tubular;
(c) actuating the casing cutter to cut the tubular;
(d) applying the first load to actuate the mechanical tension-set retrievable packer to seal the wellbore;
(e) performing a circulation test in the wellbore; and
(f) applying the second load to unset the mechanical tension-set retrievable packer to release it from the wellbore.

The method may comprise the step of determining circulation behind the cut tubular at surface. This provides a positive circulation test and the cut tubular section, preferably a casing section, can be removed.

Preferably the method includes the further steps of unsetting anchor mechanism, actuating the anchor mechanism to grip the cut tubular section at an upper location on the tubular, and removing the cut tubular section from the wellbore.

In the event that the circulation test is negative, there being no circulation behind the cut tubular, the method then comprises the further steps of unsetting anchor mechanism, locating the casing cutter at a higher position on the tubular and repeating the steps (b) to (f). This can be repeated until a positive circulation test occurs and a section of cut tubular can be removed from the wellbore.

Preferably the method includes the step of operating the disengagement assembly, so disabling the detent in a third configuration. The method may then comprise the further step of setting the mechanical tension-set retrievable packer at the operating load. In this way, the cut casing can be removed were the string is not anchored to a fixed point.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

There will now be described, by way of example only, various embodiments of the invention with reference to the drawings, of which:

Figure 1A:
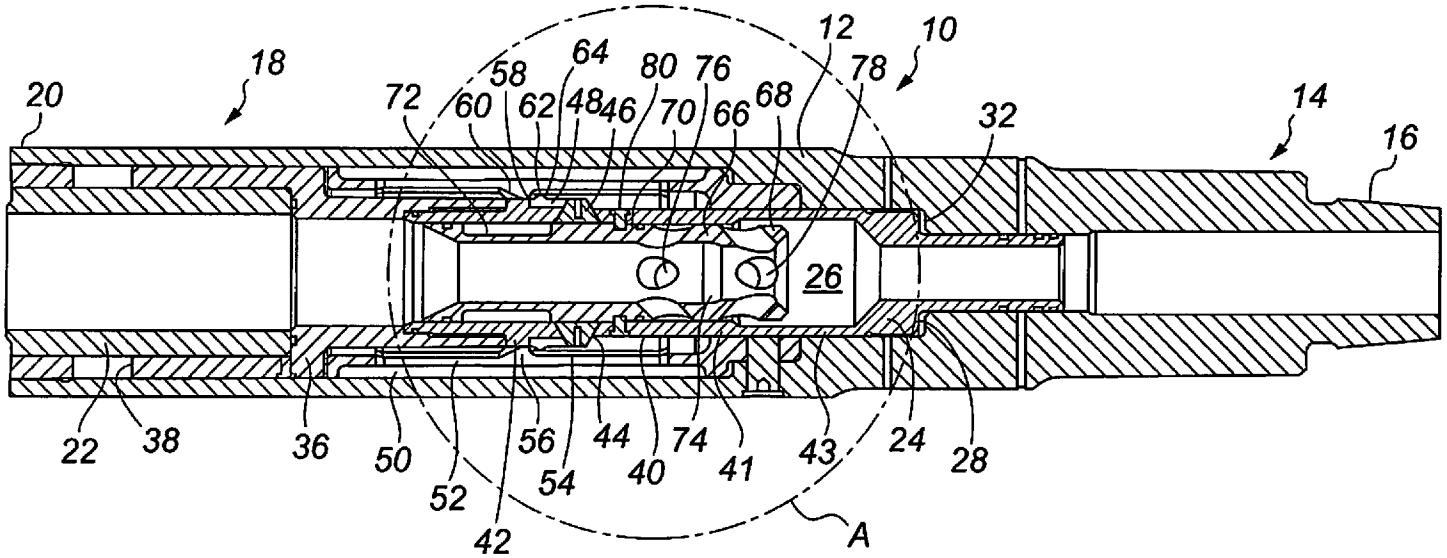
FIGS. 1A to 1E are sectional views of a resettable mechanism, with FIG. 1E being an exploded view of part of FIG. 1A, in first and second configurations and first and second positions, respectively, for use with a load set downhole tool according to an embodiment of the present invention.

Referring initially to FIGS. 1A to 1E of the drawings there is illustrated a resettable mechanism, generally indicated by reference number 10, according to an embodiment of the present invention.

Mechanism 10 comprises a tubular body 12 having, at a first end 14, a pin connector 16 for mounting the mechanism 10 in a string (not shown). A second end 18 of the body 12 is integral with the tubular body 20 of a downhole tool (not shown). A screw threaded connection may be alternatively arranged at the second end 18 for connection to the downhole tool or other part of a string which is in turn connected to the downhole tool. The downhole tool will operate by relative movement of the body 20 and an operating member 22.

An inner sleeve 24 is provided in a central throughbore 26 of the mechanism 10. Inner sleeve 24 includes a shoulder 28 towards the first end 14 which is arranged to engage a shoulder 32 of the tubular body 12 and thereby limit travel of the inner sleeve 24 through the central throughbore 26. Towards the second end 18, the inner sleeve 24 is connected to the operating member 22 of the downhole tool. This is achieved via an overshot 36 in the present embodiment, but may be by direct connection. In the present embodiment the overshot 36 is used to provide a stop face 38 and limit the stroke length to actuate the downhole tool.

On an outer surface 40 of the inner sleeve 24 towards the second end 18 there is arranged a shoulder 42. On an inner surface 41 toward the first end 14 there is arranged a circumferential recess 43. Apertures 44 through the inner sleeve 24 are provided circumferentially around the sleeve 24 between the shoulder 42 and recess 43. There are six apertures 44 but any number may be present. In a first configuration, shown in FIG. 1A, collet dogs 46 are located in each aperture 44 with the shape of apertures 44 matched to the dogs 46 to retain them so that a portion of each dog 46 protrudes from the outer surface 40. The apertures 44 and shoulder 42 are spaced apart by a size to hold a collet ring 48. Collet ring 48 is an annular band that slides over the outer surface 40 of the inner sleeve 24. It radially extends by a greater distance than that of the shoulder 42.

In a chamber 50 created between the tubular body 12 and the inner sleeve 24 there is arranged a collet 52. Collet 52 is attached to the body 12. Collet 52 provides a plurality of collet fingers as are known in the art which are arranged longitudinally to be coaxial with the axis of the central bore 26. On an inner surface 54 of each finger there is provided a detent 56. Detent 56 is a raised portion presenting a first face 58 directed towards the first end 14 and a second face 60 directed towards the second end 18. First face 58 is arranged to be near perpendicular to the axis whereas face 60 is a gentle slope. The profile of the detent 56 is matched in reverse by the profile of the collet ring 48 as it presents a third face 62 similar to the first face 58 directed towards the second end 18 and a fourth face 64 matching the second face 60 directed towards the first end 14. Like most collets 52, the fingers and detent 56 can be moved radially by a load applied to a face of the detent 56. In this embodiment, the collet load is set to move the detent 56 radially outwards when applied to the first face 58. Consequently a much lower load than the collet load will move the detent 56 radially outwards when a load is applied to the second face 60.

A disengagement assembly, generally indicated by reference numeral 66, is also present. Assembly 66 comprises a drop ball sleeve 68 located inside the inner sleeve 24 and the collet dogs 46. The outer surface 70 of the sleeve 68 includes a circumferential recess 72 towards the second end 18. Towards the first end 14 there is a drop ball seat 74 created by a narrowing of the bore of the sleeve 68. On either side of the drop ball seat 74 is arranged first ports 76 and second ports 78 respectively. The ports 76, 78 are apertures through the wall of the sleeve 68. The drop ball sleeve 68 is attached to the inner sleeve 24 by shear screws 80.

In use, the mechanism 10 is arranged in a first configuration as shown in FIG. 1A. The drop ball sleeve 68 is connected to the inner sleeve 24 so that the collet dogs 46 are located in the apertures 44 and support the collet ring 48. The inner sleeve 24 abuts the tubular body 12 by the abutment of shoulders 28,32. In this configuration the first face 58 and the third face 62 also abut to prevent movement of the inner sleeve towards the second end 18. Mechanism 10 is arranged to operate with a tension-set tool. However, it will be realised that the mechanism can be used with a weight-set tool. In either case the sting will be anchored at a fixed point in the well bore so that a load can be applied to the string. The downhole tool and resettable mechanism can be run in a well and the downhole tool, which would normally operate at a relatively low operating load, say 15 tonnes as an example, will not actuate until a load greater than the combination of the operating load and the collet load is applied. If we say in our example that the collet load is set to 30 tonnes, then a load of greater than 45 tonnes is required to actuate the downhole tool. Preferably a load of around 75 tonnes would be recommended to ensure the tool operates. In the present embodiment, when the load applied by an overpull to the string is greater than the combined combination, the detent 56 will move radially outwards and allow collet ring 48 to ride over the detent 56 so that the inner sleeve 24 moves towards the second end 18 relative to the tool body 12. Relative movement of the inner sleeve 24 causes the operating member 22 of the downhole tool to also be relatively moved and consequently the downhole tool is actuated. Thus it has taken a load well in excess of the operating load of the downhole tool, in this case a multiple of the operating load being five times the operating load, to actuate the downhole tool.

Figure 1B:
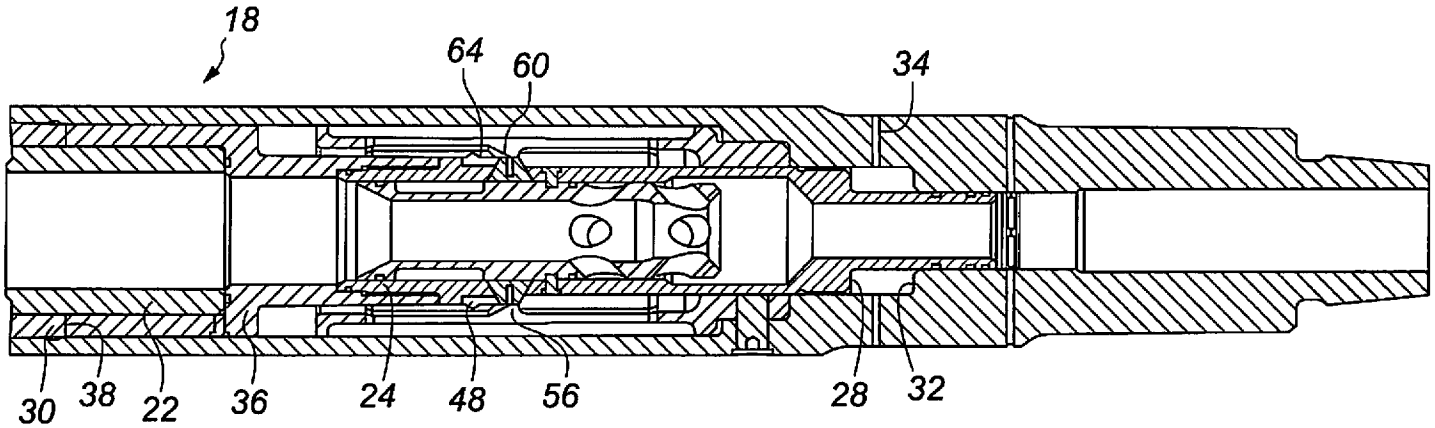

The operating configuration being a second configuration is shown in FIG. 1B. Here it is seen that the collet ring 48 has passed over the detent 56, the inner sleeve 24 has moved to towards the second end 18 with the overshot 36 moving the operating member 22 until the face 38 meets a stop 30 on the downhole tool. This is the full stroke length of the downhole tool. Shoulders 28, 32 have parted and ports 34 allow equalisation of fluid.

If weight is set down, a reverse load is applied and the overshot 36 will move relative to the tool body 12 towards the first end 14. This moves the collet ring 48 back over the detent 56. In this case the second 60 and fourth 64 faces abut but as the angle of impact is small the load required to move the collet ring 48 over the detent 56 is smaller than the first load to actuate the tool. The inner sleeve 24 will be stopped when the shoulders 28, 32 contact. This resets the mechanism 10 as it is placed back in the first configuration.

It will be appreciated that the downhole tool can be actuated and de-actuated repeatedly as the reset can be undertaken any number of times. The resettable mechanism 10 thus allows for continuous operation of a downhole tool with a relatively low operating load. Such low operating loads provide for more complex downhole tools where the components would otherwise be damaged, are not available or would be of unworkable dimensions is they had to be designed to operate at high loads.

Figure 1C:
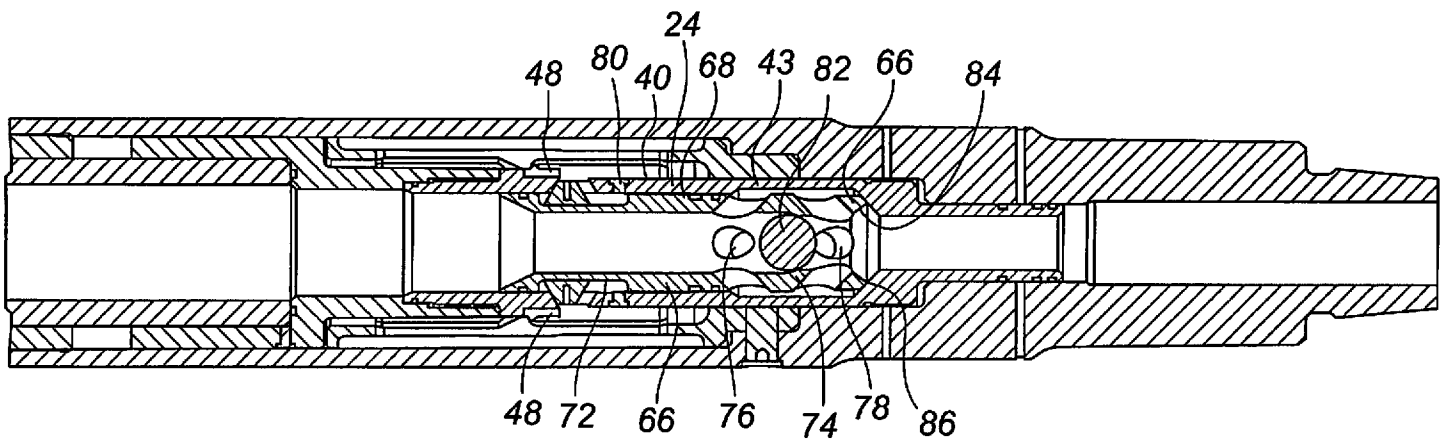

If the downhole tool requires to be actuated at its operating load, which may be needed when the string is no longer fixed in the well bore, such as when using the downhole tool in a fishing operation, the disengagement assembly 66 is operated. From a first position shown in FIG. 1A, a drop ball 82 is passed through the central bore 26 being dropped from surface through the string. The ball 82 seats in the drop ball seat 74. This blocks the passage of fluid through the mechanism 10 and fluid pumped through the bore 26 will cause a build-up of pressure on the ball 82 and the sleeve 68. This pressure will become sufficient to shear screws 80 and thereby allow the sleeve 68 to move under pressure inside the inner sleeve 24. The sleeve 66 will move until a front face 84 is stopped at a shoulder 86 on the inner sleeve 24. Movement of the drop ball sleeve 66 relative to the inner sleeve 24 causes the recess 43 in the sleeve 68 to be positioned under the collet dogs 46. Without support from the sleeve 68, the collet dogs 46 slide back into the recess 43, and no longer support the collet ring 48. This means that the collet ring is now free to move along the outer surface 40 of the inner sleeve 24. Additionally the ports 76,78 are now aligned with the recess 43, allowing fluid flow passed the drop ball 82. This may be considered as a second position for the disengagement assembly and is shown in FIG. 1C.

Figure 1D:
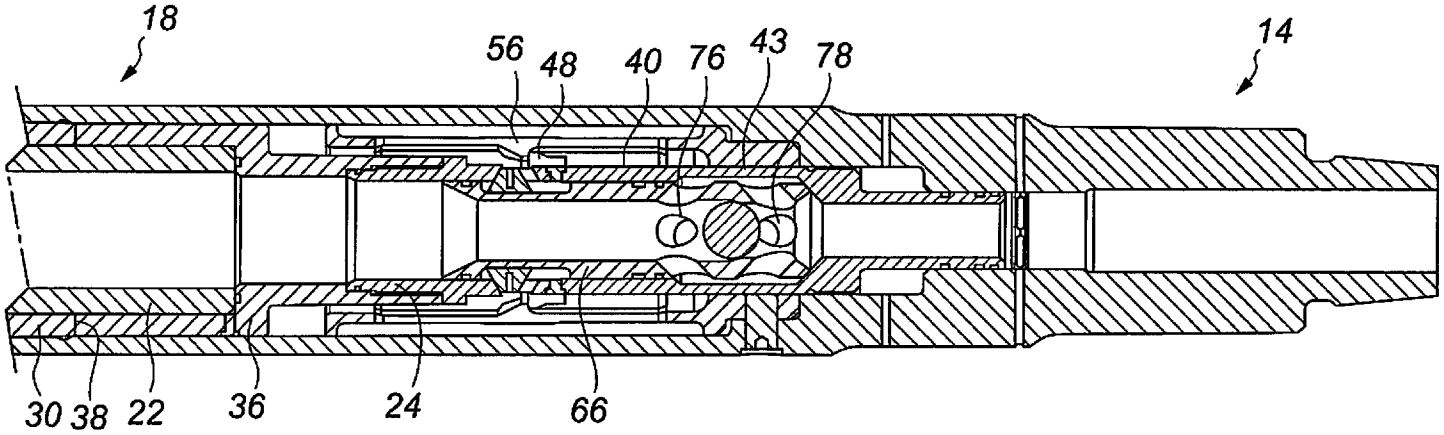
Figure 1E:
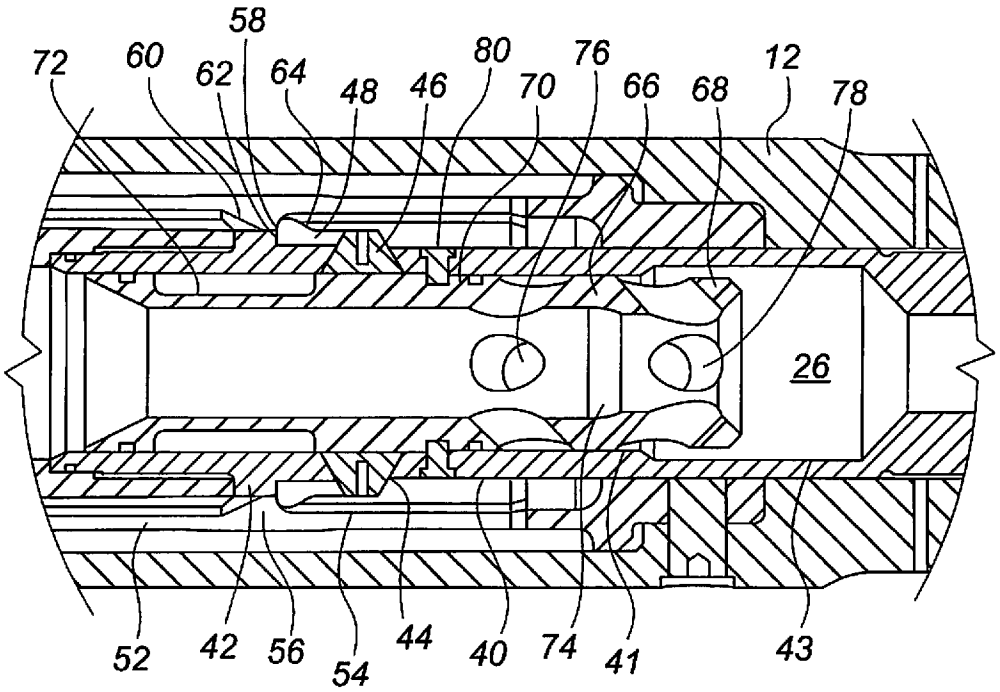

To actuate the downhole tool now requires only the operating load as movement of the collet ring 48 and inner sleeve 24 is no longer prevented by the detent 56. Indeed the collet ring 48 is now free to move along the outer surface 48 away from the detent 56 towards the first end 14. When a load is applied the inner sleeve 24 will move relative to the tool body 12, the collet ring 48 does not have to ride over the 56 and thus the sleeve 24 moves passed the detent 56 unimpeded. Thus the detent 56 is disengaged. The load applied to the inner sleeve 24 now only requires to be at the operating load for the downhole tool to move the operating member and thereby actuate the downhole tool. Additionally, as the drop ball sleeve 66 abuts the inner sleeve 24, fluid flow is maintained between the ends 18,14 of the mechanism 10 via the ports 76, 78 and recess 43. This is as illustrated in FIG. 1D.

Figure 2A:
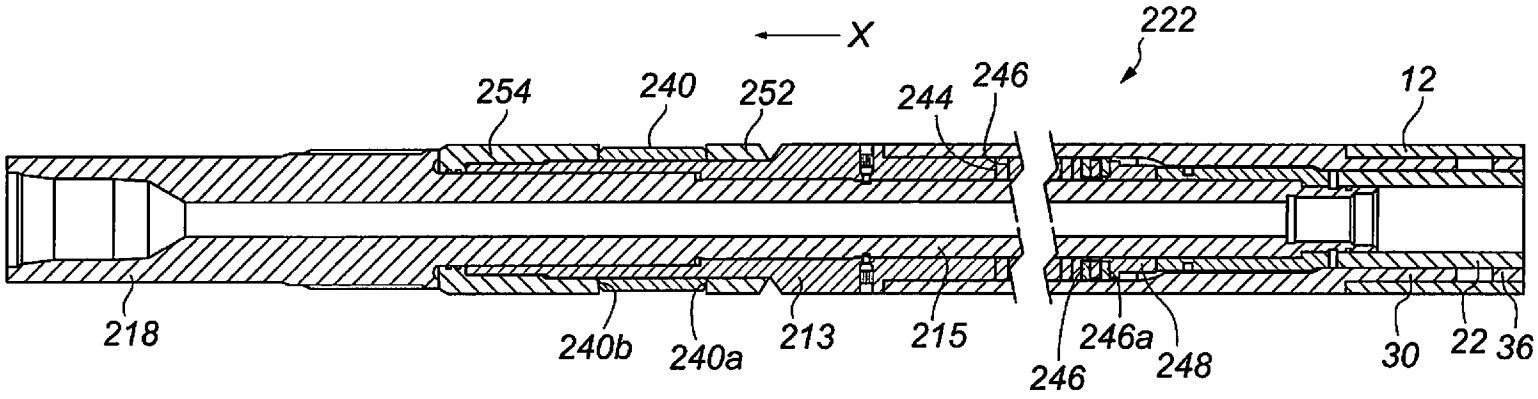
FIGS. 2A and 2B are sectional views of a mechanical tension-set retrievable packer for use with the resettable mechanism of FIGS. 1A to 1D, in unset and set states, respectively, according to an embodiment of the present invention.
Figure 2B:
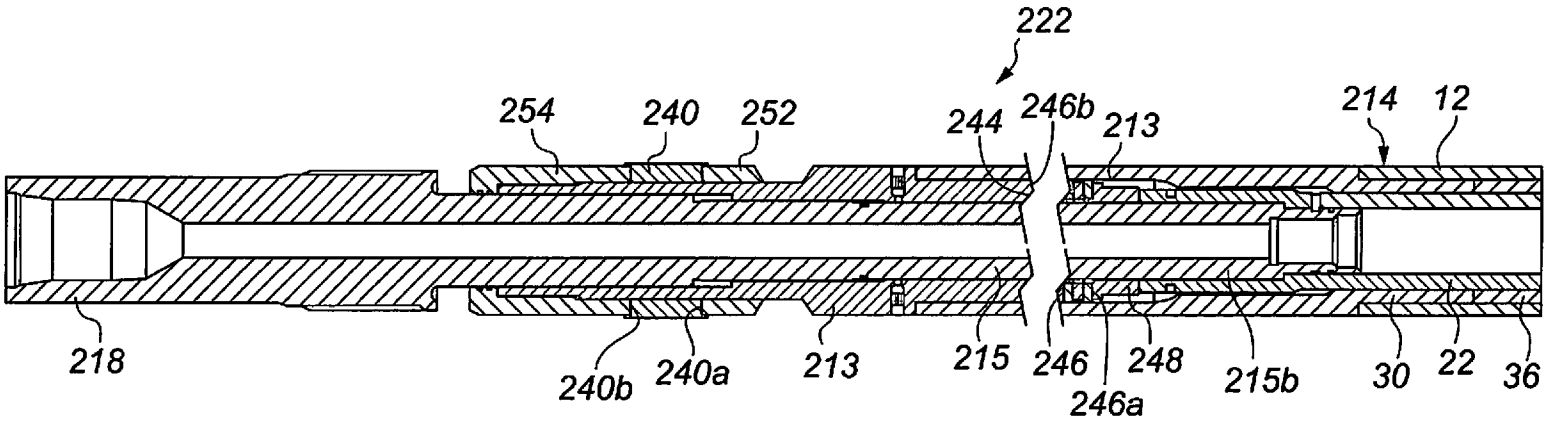

Reference is now made to FIGS. 2A and 2B which are enlarged longitudinal sectional views of a mechanical tension-set retrievable packer, generally indicated by reference numeral 222, according to an embodiment of the present invention. The mechanical tension-set retrievable packer 222 comprises a packer element 240. The packer element 240 is typically made from a material capable of radially expanding when it is axially compressed such as rubber or other elastomeric material.

The packer 222 has a mandrel 215 movable in relation to the body 213. A spring compression ring 248 is mounted on the second end 215*b* of the mandrel. The spring compression ring 248 is configured to engage a first end 246*a* of spring 246. For brevity the entire length of spring 246 is not illustrated but indicated by the cross lines. The second end 46*b* of the spring 246 is connected and/or engages shoulder 244 on the tool body 213. The mandrel 215 is movably mounted on the body 213 and is biased to a first position shown in FIG. 2A by spring 246.

At a first end 214 the packer 222 is connected to the resettable mechanism 10 of FIGS. 1A to 1D. Those parts of FIGS. 1A to 1D viewable on the drawings are marked. The operating member 22 thus forms the mandrel 215 and body 12 is integral with body 213.

The mandrel is configured to move from a first mandrel position shown in FIG. 2A to a second mandrel position shown in FIG. 2B when an upward tension or force is applied to the packer 222 via the drill string (not shown) connected thereto at a second end 218.

In the first mandrel position the spring force of spring 246 maintains the position of the mandrel 215 relative to the body 213. The packer element 240 is not compressed.

In the second mandrel position the mandrel 215 moves relative to the body 213, the upward force acting on the mandrel 215 moves the spring compression ring 248 in a direction X which compresses the spring 246. A lower gauge ring 252 mounted on the mandrel 215 engages a first edge 240*a* of the packer element 240. An upper gauge ring 254 mounted on the tool body 213 engages a second edge 240*b* of the packer element.

An upward force acting on the packer 222 moves the lower gauge ring 252 toward the upper gauge ring 254 compressing the packer element 240. Compression of the packer element 240 causes it to radially expand to contact the casing and seal the annulus of the wellbore.

The upward force or tension applied to the packer 222 has a pre-set lower threshold such that the spring force of spring 246 is overcome when upward force or tension is applied above the lower threshold. The lower threshold may be the minimum force or tension required to overcome the spring force of spring 246. The lower threshold is set so that actuation will occur once an operating load is applied. An example operating load may be 15 tonnes. However, when the resettable mechanism 10 is part of the packer 222 a greater load is required to actuate the packer 222. This increased load is determined by the collet load in the mechanism 10. If we were to attempt to design a tension-set packer operable on the increased load, the springs 246 would be excessively long and such a packer would be impractical. By using the resettable mechanism 10, the packer 222 can now be set using an increased load which can be adjusted so that it is greater than any unexpected loading which may occur on the drill string in use. Such variable loading is typically experienced when the string is run form a floating rig. Additionally, the resettable mechanism 10 allows the packer 222 to be unset and reset any number of times without requiring the packer to be pulled out of the well.

Figures 3A, 3B, 3C, 3D, 3E, 3F:
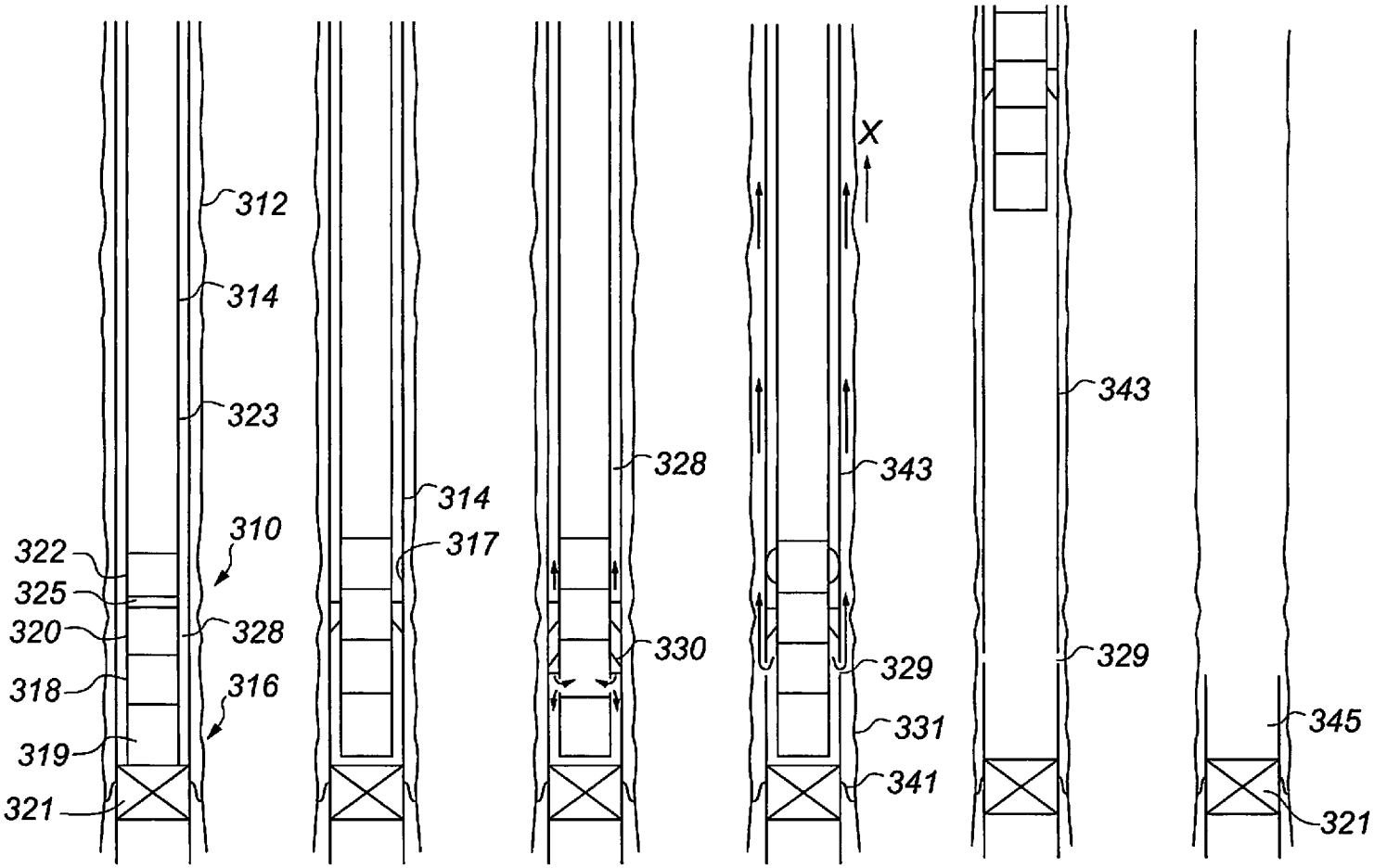
FIGS. 3A to 3F provide schematic illustrations of a casing cutting and removal assembly in a method according to an embodiment of the present invention.

Referring now to FIG. 3A of the drawings there is illustrated a casing cutting and removal assembly, generally indicated by reference numeral 310, run into a wellbore 312 which is lined with casing 314 or other tubular. Casing cutting and removal assembly 310 includes, from a first end 316, a casing cutter 318, an anchor mechanism 320 and a mechanical tension-set retrievable packer 322 which includes a resettable mechanism 325 arranged on a drill string 323 or other tool string according to an embodiment of the present invention.

The casing cutter 318, anchor mechanism 320 and mechanical tension-set retrievable packer 322 with the resettable mechanism 325 may be formed integrally on a single tool body or may be constructed separately and joined together by box and pin sections as is known in the art. Two parts may also be integrally formed and joined to the third part.

Anchor mechanism 320 may be considered as a casing spear. The anchor mechanism 320 may be of any configuration to grip the casing 314. A typical anchor mechanism 320 may comprise slips which move over a cone to extend and grip the casing 314. By application of fluid pressure in the central throughbore of the string 323, the slips will engage the inner surface 317 of the casing 314. If tension is applied by overpulling the drill string 323 and the tool 310, the slips are further forced outwards to grip the inner surface 317 of the casing 314. This anchors the tool 310 to the casing 314 and sets the anchor mechanism preventing accidental release. Changing fluid pressure through the anchor mechanism will not deactivate the slips. The slips and anchor mechanism will release when the tension is removed and weight is set down on the string 323. The anchor mechanism 320 therefore provides a fixed point against which a load may be applied, either by pulling to tension or by setting down weight on the drill string 323.

A bearing on the tool body connects the anchor mechanism 320 with the tool body. The anchor mechanism 320 is rotatably mounted on the body and is configured to secure the tool 310 against the wellbore casing 314. An upward force applied to the tool body may also apply pressure to the bearing and may facilitate the rotation of the lower tool body which will be connected to the casing cutter 318 and thus allow rotation thereof.

Casing cutter 318 may be any type of casing cutter. In the embodiment shown, the casing cutter 318 comprises a plurality of blades 330 which extend by the application of fluid pressure through the drill string 323. The blades 330 rotate to cut through the wall of the casing 314. Preferably fluid flows over the blades 330 to provide cooling and lubrication. Such fluid flow also removes the casing cuttings.

In use, the casing cutting and removal assembly 310 is assembled on a drill string 323, in the order of the mechanical tension-set retrievable packer 322 with resettable mechanism 325, the anchoring mechanism 320 and the casing cutter 318. There may also be a drill 319 mounted on the end 316 for dressing a cement plug 321 already located in the casing 314. Alternatively, a bridge plug (not shown) could replace the drill 319 and be set in the casing 314 in place of the cement plug 321.

Referring to FIG. 3A of the drawings, the casing cutting and removal assembly 310 is run-in the wellbore 312 and casing 314 until it reaches the cement plug 321. At this point a wellbore integrity test can be performed using the anchor mechanism 320 and the mechanical tension-set retrievable packer 322, if desired. With the casing cutter 318, anchor mechanism 320 and mechanical tension-set retrievable packer 322 all held in inactive positions, fluid can be pumped at a fluid pressure below a pre-set threshold through the bore of the drill string 323 to hydraulically activate the drill 319. This does not actuate the casing cutter 318, anchor mechanism 320, the mechanical tension-set retrievable packer 322 or the resettable mechanism 325. The drill 319 is used to dress the cement plug 321.

The casing cutting and removal assembly is then pulled up to locate the blades 330 of the casing cutter 318 at a desired location to cut the casing 314. At this position, the anchor mechanism 320 is hydraulically actuated to grip the casing surface 317 to secure the axial position of the tool 310 in the wellbore. The fluid circulation rate through bore 325 is increased and the anchor mechanism 320 grips the casing 314. The tool 310 is then anchored to the casing by reversibly setting the anchor mechanism 320 by pulling the string 323.

Once the anchor mechanism 320 has engaged the casing 14 and is set, as illustrated in FIG. 1B, the casing cutter 318 can be actuated. Note that the casing 314 is held in tension when the casing cutter 318 is operated. The mechanical tension-set packer 322 and resettable device 325 are not affected by setting of the anchor mechanism 320 or the casing cutting as the tension applied is lower than the combined operating load and collet load.

During the cutting operation the anchor mechanism 320 remains substantially stationary relative to the casing cutter 318, with rotation of the casing cutter being made possible via the bearing. Fluid flows out of the string 323 at the blades 330 and this is illustrated in FIG. 3C which arrows showing the direction of fluid flow. It is noted that upward flow travels in the annulus 328 passed the mechanical tension-set retrievable packer 322 without any obstructions in the annulus 328 at the location of the mechanical tension-set retrievable packer 322.

If a kick occurs in the wellbore 312 for any reason, the mechanical tension-set retrievable packer can be rapidly set to seal the wellbore by simply applying greater tension to the drill string 323 to set the packer. This is described hereinbefore with reference to FIGS. 2A and 2B. The load applied being great enough to overcome the detent in the resettable mechanism 325 so that the packer 322 can set.

When the casing cutter 318 has finished cutting the casing, the casing cutter is deactivated.

To perform a circulation test the mechanical tension-set retrievable packer 322 is first set to seal the casing 314. To set the packer an upward tension or pulling force is applied to the drill string as shown by arrow X in FIG. 3D. In this example 60,000 lbs of upward tension or pulling force is applied to the drill string. As described hereinbefore the load applied is great enough to overcome the detent in the resettable mechanism 325 so that the packer 322 can set. As the packer element is axially compressed it radially expands to engage the casing and seals the casing annulus 328. The upward force is maintained to seal of the wellbore. This is as illustrated in FIG. 3D.

The annulus 328 is now sealed off and pressurised fluid pumped through the drill string 323 will enter the annulus 328 and travel through the cut 329 in the casing 314. While fluid can travel down between the casing 314 and the formation 331 it will be stopped at cement 341. In this way, the fluid will be forced upwards between the casing 314 and the formation 331 towards the surface. A recording of pressure in the annulus behind the casing at surface indicates a positive circulation test and that the annulus behind the casing is free of debris which may cause the casing 314 to stick when removed. The casing 314 can now be removed.

On completion of the circulation test, the upward force or tension applied to the drill string is reduced to deactivate the mechanical tension-set retrievable packer 322 and the resettable mechanism moves to its first configuration and has reset. The packer element returns to its original uncompressed state and moves away from the well casing 314.

To unset and release the anchor mechanism 320 a downward force is applied. This weight setting operation can merely be a continuation of the release of tension which unset the packer 322.

The tool 310 is now relocated to a new axial position in the casing 314 with the anchor mechanism 320 located at an upper end of the cut section of casing 343. In this position the anchor mechanism 320 is activated to grip the casing section 343 as described above and as illustrated in FIG. 3E.

By pulling the drill string 323 and the casing cutting and removal assembly 310 from the wellbore 312, the cut section of casing 343 is removed from the wellbore 312. The wellbore 312 now contains the casing stub 345 and cement plug 321 as shown in FIG. 3F.

In the event that the circulation test is negative, that is a pressure increase is not seen at surface, then it is assumed that cement or other debris is located in the annulus between the cut casing 343 and the formation 331 which will prevent movement and subsequent recovery of the cut casing section 343. The drill string 323 and casing cutting and removal assembly 310 are then pulled up the casing to locate the blades 330 of the casing cutter 318 at a location higher in the well on the cut casing section 343.

At this new position the method is undertaken again starting from FIG. 3B with the anchor mechanism 320 being reset. As the anchor mechanism 320, casing cutter 318 and mechanical tension-set retrievable packer 322 are all retrievable, they can be operated multiple times in a single trip in the wellbore 312 until a section of casing is removed.

Additionally, if the string 323 experiences movement against the anchor mechanism 320 caused by the movement of the rig from which the string 323 and assembly 310 is deployed, the resultant load will still be less than the combined operating load and collet load so that the retrievable mechanical tension-set packer 322 cannot be accidentally actuated.

The retrievable mechanical tension-set packer 322 can also be used to assist in retrieval of the casing section 343 is desired. As casing section 343 is now free, the string 323 is now no longer anchored at a fixed point and thus tension can only be applied against the weight of the casing section 343. In the event that this does not provide a sufficient load differential to activate the anchor mechanism 320 and/or packer 322, the packer 322 can be set at its operating load. This is achieved by dropping a ball through the drill string 323. The ball seats in a disengagement assembly of the resettable mechanism 325 and desupports the collet ring, thereby removing the detent. Consequently the packer 322 can then be set by its much lower operating load.

The principal advantage of the present invention is that it provides a resettable mechanism to prevent accidental actuation of a load set downhole tool.

A further advantage of an embodiment of the present invention is that it provides a high overpull tension-set packer which is resettable.

A still further advantage of an embodiment of the present invention is that it provides a casing cutting and removal assembly on which multiple circulation tests can be performed on a single trip in the well.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

We claim:

1. A resettable mechanism for preventing the accidental actuation of a load set downhole tool, the downhole tool being actuated by an operating load, the resettable mechanism comprising:

a substantially tubular body having a central throughbore, with first and second ends;

an inner actuating member, the inner actuating member being an annular body having a first end for connection to an operating member of the downhole tool; a collet including a detent, the detent having first and second faces and the detent being radially moveable upon application of a load;

a collet ring, the collet ring having third and fourth faces;

the collet and collet ring being arranged within the tubular body, so that: in a first configuration the first face can abut the third face and the detent prevents movement of the inner actuating member until a first load is applied in a first direction; and in a second configuration the detent prevents movement of the inner actuating member until a second load is applied in a second direction relative to the tubular body when the second face abuts the fourth face; and wherein the first load is greater than a combined load of the operating load and a collet load; and the second load is applied in reverse to the first load.

2. The resettable mechanism according to claim 1 wherein the collet is attached to the tubular body.

3. The resettable mechanism according to claim 1 wherein the collet is formed integrally with the tubular body.

4. The resettable mechanism according to claim 1 wherein the detent is directed radially inwards.

5. The resettable mechanism according to claim 1 wherein the collet ring is supported on the inner actuating member.

6. The resettable mechanism according to claim 1 wherein the resettable mechanism comprises a disengagement assembly, the disengagement assembly disabling the detent so that the downhole tool can be actuated at the operating load in a third configuration.

7. The resettable mechanism according to claim 6 wherein the disengagement assembly comprises a collet ring support means, the support means holding the collet ring against a shoulder on the inner actuating member in a first position and releasing the collet ring to move relative to the inner actuating member in a second position.

8. The resettable mechanism according to claim 7 wherein the support means comprises a plurality of collet dogs arranged circumferentially around the inner actuating member.

9. The resettable mechanism according to claim 8 wherein each collet dog is located in a retaining aperture through the inner actuating member.

10. The resettable mechanism according to claim 9 wherein each collet dog protrudes from an outer surface of the inner actuating member to provide a face to abut against the collet ring in the first position.

11. The resettable mechanism according to claim 7 wherein the collet dogs are held in the first position by an inner sleeve located in the central throughbore.

12. The resettable mechanism according to claim 11 wherein the inner sleeve includes a ball seat and the inner sleeve is held to the inner actuating member by one or more shear screws in the first position.

13. The resettable mechanism according to claim 12 wherein the inner sleeve comprises first and second ports arranged on either side of the ball seat.

14. The resettable mechanism according to claim 13 wherein the ports align with a recess on the inner actuating member in the second position so that a fluid pathway is maintained from a first end to a second end of the resettable mechanism.

15. The resettable mechanism according to claim 11 wherein the inner sleeve includes an inner recess into which the collet dogs will fall when the disengagement assembly moves into the second position.

16. A resettable mechanism according to claim 1, further comprising the load set downhole tool wherein the load set downhole tool is a high overpull mechanical tension-set retrievable packer configured to seal to casing or a downhole tubular, comprising:

the substantially tubular body having central throughbore, with the first and the second ends including connection means for mounting in a string;

a mandrel which is configured to be axial moveable relative to the substantially tubular body;

at least one packer element; and wherein the mandrel is connected to the inner actuating member.

17. The resettable mechanism according to claim 16, further comprising:

an anchor mechanism configured to grip a section of a tubular in a wellbore; and a casing cutter configured to cut the tubular;

wherein the anchor mechanism is located between the mechanical tension-set retrievable packer and the casing cutter to thereby provide a casing cutting and removal assembly.

18. A method of controlled actuation of a load set downhole tool;

the method comprising the steps:

(a) mounting a resettable mechanism with a load set downhole tool in a string;

the resettable mechanism comprising:

a substantially tubular body having a central throughbore, with first and second ends;

an inner actuating member, the inner actuating member being an annular body having a first end for connection to an operating member of the downhole tool;

a collet including a detent, the detent having first and second faces and the detent being radially moveable upon application of a load; and a collet ring, the collet ring having third and fourth faces;

and connecting the inner actuating member to an operating member of the downhole tool;

(b) arranging the resettable mechanism in a first configuration wherein the first face can abut the third face and the detent prevents movement of the inner actuating member in a first direction;

(c) applying a first load, greater than an operating load of the downhole tool and a collet load, in the first direction sufficient to move the collet radially and allow the inner actuating member to move in the first direction to the second configuration and thereby actuate the downhole tool; and (d) applying a second load, in the second direction so as to abut the second face and the fourth face and then move the collet ring over the detent to return the mechanism to the first configuration and thereby reset the mechanism and deactivate the downhole tool.

19. The method according to claim 18 wherein the method includes repeating steps (c) and (d) to repeatedly actuate the downhole tool.

* * * * *